US008744287B2

(12) United States Patent
Takahashi

(10) Patent No.: US 8,744,287 B2
(45) Date of Patent: Jun. 3, 2014

(54) IMAGE FORMING APPARATUS

(75) Inventor: Kazuhiko Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 219 days.

(21) Appl. No.: 13/402,628

(22) Filed: Feb. 22, 2012

(65) Prior Publication Data

US 2013/0039668 A1 Feb. 14, 2013

(30) Foreign Application Priority Data

Aug. 12, 2011 (JP) ..... 2011-177004

(51) Int. Cl.
*G03G 15/00* (2006.01)
*G03G 15/08* (2006.01)
*G03G 21/18* (2006.01)

(52) U.S. Cl.
USPC ..... 399/25; 399/26; 399/27; 399/30; 399/53; 399/120; 399/260

(58) Field of Classification Search
USPC ..... 399/25, 26, 27, 30, 53, 120, 260
See application file for complete search history.

(56) References Cited

U.S. PATENT DOCUMENTS 5,508,795 A * 4/1996 Kikuchi ..... 399/27
5,708,912 A * 1/1998 Lee ..... 399/24
2010/0303499 A1 12/2010 Mori et al.

FOREIGN PATENT DOCUMENTS

JP 11-109752 A 4/1999
JP 2010-276961 A 12/2010

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes an information rewrite unit that rewrites information stored in a storage if an empty detector detects that a toner container is empty and the toner container is at least allowed to be released, and then if the empty detector detects that the toner container is not empty.

3 Claims, 16 Drawing Sheets

IMAGE FORMING APPARATUS

CROSS-REFERENCE TO RELATED APPLICATIONS

This application is based on and claims priority under 35 USC 119 from Japanese Patent Application No. 2011-177004 filed Aug. 12, 2011.

BACKGROUND

The present invention relates to an image forming apparatus.

SUMMARY

According to an aspect of the invention, there is provided an image forming apparatus including a housing; an image holding body that is housed in the housing and holds a toner image; an image forming unit that is housed in the housing and forms the toner image on the image holding body; a cartridge that includes at least the image holding body and is removably mounted on the housing; a toner container that is removably mounted on the cartridge, houses a toner therein, and supplies the toner to the image forming unit; a retaining mechanism that retains the toner container with respect to the cartridge; a storage that is provided at a certain position of at least one of the cartridge and the toner container and stores first information relating to a use amount of the toner in the toner container and second information relating to a use amount of an image holding portion, which is a component not including the toner container and including at least the image holding body from among components installed in the cartridge; an information update unit that updates the first information in accordance with use of the toner in the toner container, and updates the second information in accordance with use of the image holding portion; an empty detector that is housed in the housing and detects whether or not the toner container is empty; a retention controller that at least allows the toner container retained by the retaining mechanism to be released if the empty detector detects that the toner container is empty, and causes the retaining mechanism to retain the toner container if the empty detector detects that the toner container is not empty; and an information rewrite unit that rewrites information stored in the storage if the empty detector detects that the toner container is empty and the toner container is at least allowed to be released, and then if the empty detector detects that the toner container is not empty.

BRIEF DESCRIPTION OF THE DRAWINGS

Exemplary embodiment(s) of the present invention will be described in detail based on the following figures, wherein.

DETAILED DESCRIPTION

Exemplary embodiments of the present invention will be described below with reference to the drawings.

General Configuration of Image Forming Apparatus

Figure 1:
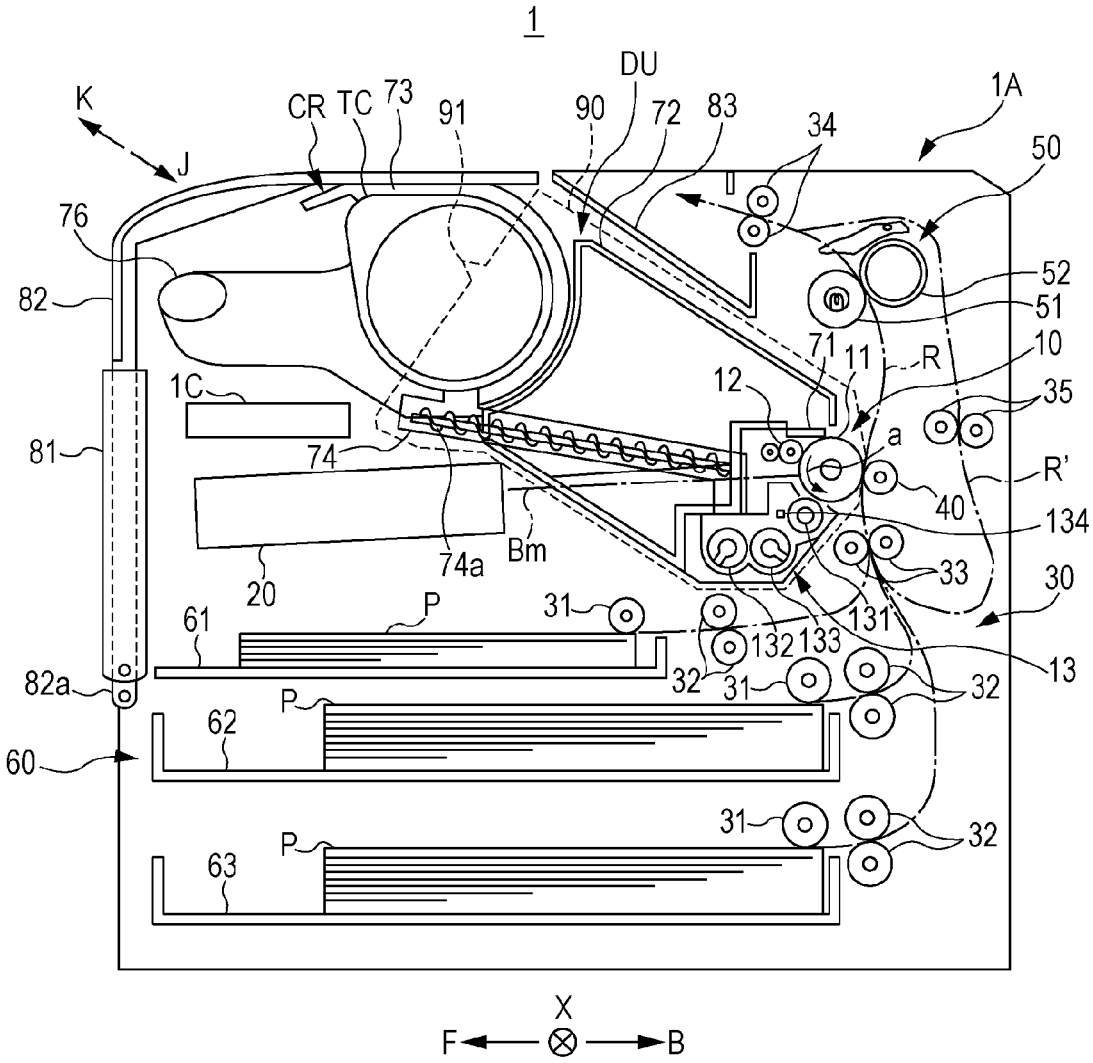
FIG. 1 is a cross-sectional view showing a general configuration of an image forming apparatus according to an exemplary embodiment of the invention.
Figure 2:
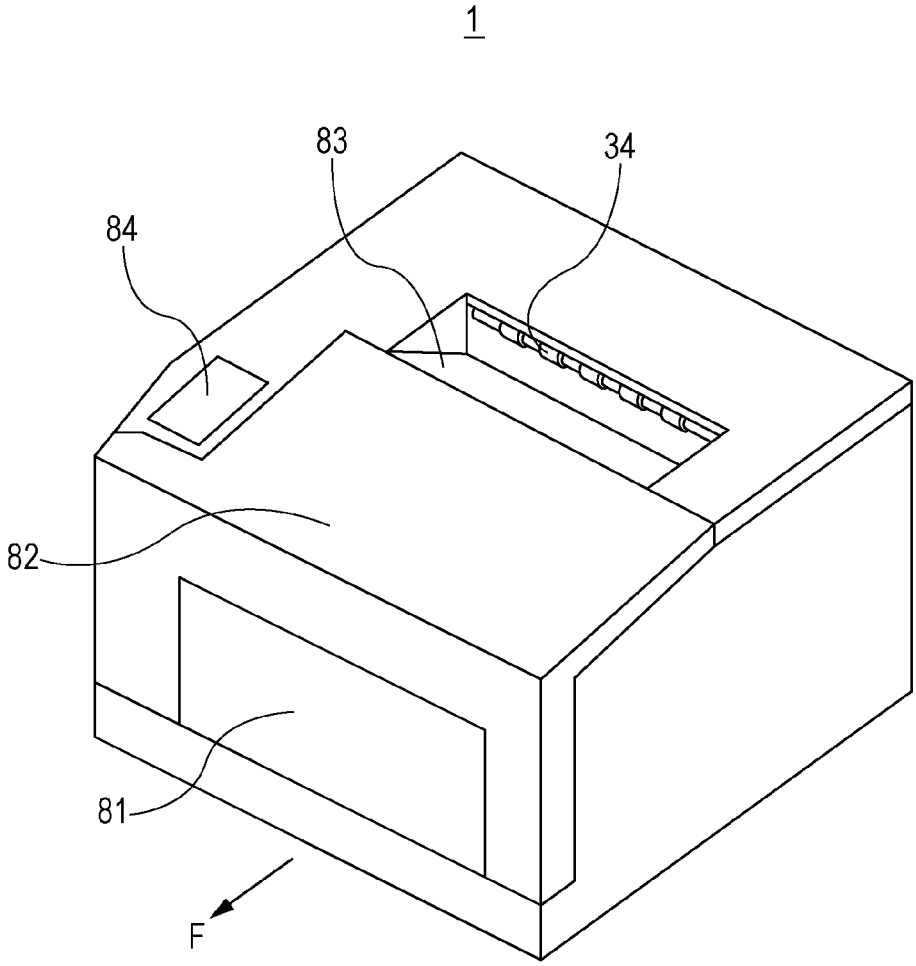
FIG. 2 is a perspective view showing an appearance of the image forming apparatus shown in FIG. 1.

FIG. 1 is a cross-sectional view showing a general configuration of an image forming apparatus according to an exemplary embodiment of the invention. FIG. 2 is a perspective view showing an appearance of the image forming apparatus shown in FIG. 1.

An image forming apparatus 1 shown in FIGS. 1 and 2 is a printer that prints an image on a sheet by using an electrophotographic system. The image forming apparatus 1 is an apparatus corresponding to not only a sheet that is a recording medium of paper, but also a recording medium of resin such as an OHP sheet. In the following description, a sheet is representatively used as a recording medium unless otherwise noted.

The image forming apparatus 1 includes a toner-image forming and holding section 10, an exposure unit 20, a sheet transport device 30, a transfer unit 40, a fixing unit 50, and a sheet housing section 60. The toner-image forming and holding section 10 includes a photoconductor drum 11, a charging unit 12, and a developing unit 13.

The photoconductor drum 11 has a cylindrical surface, and is rotationally driven around the axis of the cylinder in a direction indicated by arrow a by a motor (not shown). The photoconductor drum 11 holds an electrostatic latent image and a toner image formed on the surface. The photoconductor drum 11 corresponds to an example of an image holding body.

The charging unit 12 charges the surface of the photoconductor drum 11 with electricity. The charging unit 12 is a charging roller that rotates while being in contact with the photoconductor drum 11 in this exemplary embodiment. Alternatively, a non-contact charging unit such as a corotron may be used.

The exposure unit 20 causes the photoconductor drum 11 to be exposed to light and forms an electrostatic latent image on the photoconductor drum 11. The exposure unit 20 scans the surface of the photoconductor drum 11, which has been electrically charged by the charging unit 12, with a light beam Bm based on an image signal provided from the outside, and forms a latent image on the surface of the photoconductor drum 11. The exposure unit 20 scans the surface of the photoconductor drum 11 with the light beam Bm in an axial direction X in which the rotation axis of the photoconductor drum 11 extends.

The developing unit 13 develops the latent image on the photoconductor drum 11 with a toner and forms a toner image on the photoconductor drum 11. The developing unit 13 includes stirring members 132 and 133 that stir a developer containing a toner and a magnetic carrier, and a developing roller 131 that transports the stirred developer onto the photoconductor drum 11. Also, the developing unit 13 has installed therein a sensor 134 that detects the toner ratio of the toner in the developer in the developing unit 13. The developing unit 13 corresponds to an example of an image forming unit. Although the detail will be described later, the combination of the sensor 134 and a controller 1C (described later) corresponds to an example of an empty detector.

The transfer unit 40 is a roller that rotates with a sheet pinched between the roller and the photoconductor drum 11. The transfer unit 40 transfers the toner image on the photoconductor drum 11, onto a sheet.

The fixing unit 50 fixes the toner image transferred from the photoconductor drum 11 onto the sheet. The fixing unit 50 includes a heat roller 51 and a pressure roller 52, so as to apply heat and pressure to the toner while the sheet with the toner image to be fixed is pinched by and passes through the heat roller 51 and the pressure roller 52.

The sheet housing section 60 houses sheets on which images are formed. The sheet housing section 60 includes three sheet housing portions 61, 62, and 63 that house three types of sheets. The two lower sheet housing portions 62 and 63 from among the three sheet housing portions 61 to 63 are pulled out in a forward direction F from a front surface of the image forming apparatus 1 by an operator, sheets are supplied to the sheet housing portions 62 and 63, and the sheet housing portions 62 and 63 are pushed in a rearward direction B to be accommodated in the image forming apparatus 1. Hence, the two sheet housing portions 62 and 63 become ready for formation of images on sheets. The remaining upper sheet housing portion 61 from among the three sheet housing portions 61 to 63 is exposed to the outside when a manual feed panel 81 provided at the front surface of the image forming apparatus 1 is opened in the forward direction F, and then sheets are supplied to the sheet housing portion 61.

The sheet transport device 30 transports a sheet along a transport path R that passes through a transfer position. The transfer position is a position at which a toner image is transferred on a sheet from the photoconductor drum 11, and a position at which a sheet is pinched between the photoconductor drum 11 and the transfer unit 40. The sheet transport device 30 includes pickup rollers 31, separation rollers 32, registration rollers 33, output rollers 34, and reverse transport rollers 35. The pickup rollers 31 pick up sheets from the sheet housing portions 61 to 63. The separation rollers 32 separate the sheets picked up by the pickup rollers 31, one by one. The registration rollers 33 feed a sheet to the transfer unit 40 at a timing corresponding to a timing at which a toner image is formed on the photoconductor drum 11. The output rollers 34 output the sheet with the toner image fixed by the fixing unit 50, to the outside of the image forming apparatus 1. The sheet output by the output rollers 34 is output onto an output tray 83 provided in an upper area of the image forming apparatus 1. Part of the output sheet protruding from the output tray 83 is placed on a panel 82. The panel 82 is a member that covers the front surface and upper surface of the image forming apparatus 1. When the panel 82 is rotated in the forward direction F around a shaft 82*a* provided at the front surface of the image forming apparatus 1, mechanisms inside the image forming apparatus 1 are exposed. If duplex printing is executed, the output rollers 34 rotate backward when the output rollers 34 have transported a sheet halfway, and transport the sheet along a reverse transport path R'. The reverse transport rollers 35 transport the sheet along the reverse transport path R' and feed the sheet to the registration rollers 33. Thus, a new image is formed on a surface of the sheet opposite to the surface on which the image has been formed.

The image forming apparatus 1 according to this exemplary embodiment is an apparatus of a type called front feeder. Sheets are fed from the front surface side of the image forming apparatus 1. In the image forming apparatus 1, sheets P supplied to the sheet housing portions 61 to 63 from a position in the forward direction F with respect to the image forming apparatus 1 are transported in a rear area of the image forming apparatus 1, or more particularly along the transport path R provided in the rearward direction B with respect to the photoconductor drum 11 from the lower side to the upper side. A sheet P with an image formed thereon is output in the forward direction F onto the output tray 83 in the upper area of the image forming apparatus 1. In the image forming apparatus 1, new sheets are supplied and sheets with images formed thereon are removed by the operator at the position in the forward direction F with respect to the apparatus. Hence, the image forming apparatus 1 may be installed at a location where no spatial margin is provided on both sides in the axial direction X of the image forming apparatus 1. An image reading device may be arranged above the image forming apparatus 1 with a gap provided for removal of sheets and replacement of parts. Although described later, a process cartridge CR and a toner container (toner cartridge) TC are also removed and mounted in the forward direction F.

The image forming apparatus 1 also includes the controller 1C, a cleaner 71, a recovery toner housing box 72, a container mount portion 73, a toner feeder 74, and a display screen 84.

The controller 1C controls respective portions of the image forming apparatus 1. Although the detail will be described later, the controller 1C corresponds to an information update unit, an information rewrite unit, a retention controller, and a supply controller.

The cleaner 71 is in contact with the photoconductor drum 11 and removes the remaining toner on the photoconductor drum 11 after the toner image is transferred on the sheet, to clean the photoconductor drum 11. The cleaner 71 is a plate-like blade extending along the photoconductor drum 11.

The recovery toner housing box 72 houses the toner removed from the photoconductor drum 11 by the cleaner 71.

The toner container (toner cartridge) TC is removably mounted on the container mount portion 73. A toner for supply to the developing unit 13 is housed in the toner container TC. The toner container (toner cartridge) TC corresponds to an example of a toner container.

The toner feeder 74 feeds the toner housed in the toner container TC to the developing unit 13. The toner feeder 74 has a structure in which a spiral blade member 74*a* is arranged in a tube extending from a lower portion of the toner container TC to an upper portion of the developing unit 13. The toner feeder 74 transports the toner from the toner container TC to the developing unit 13 by rotation of the blade member 74*a*.

Although the detail will be described later, in this exemplary embodiment, the toner is properly fed from the toner container TC into the developing unit 13 because the toner feeder 74 is driven under control by the controller 1C. Consequently, the toner ratio of the toner in the developer in the developing unit 13 is maintained at a predetermined ratio or higher. However, if the toner container TC becomes empty of the toner, the toner ratio of the toner in the developing unit 13 is not increased even if the toner feeder 74 is driven. The toner ratio becomes below the predetermined ratio. In this exemplary embodiment, if the sensor 134 installed in the developing unit 13 detects that the toner ratio of the toner in the developing unit 13 becomes below the predetermined ratio, the controller 1C expects that the toner container TC becomes empty of the toner, and causes the display screen 84 to display a message for requesting the operator to replace the toner container TC.

The above-described toner-image forming and holding section 10, the cleaner 71, the recovery toner housing box 72, the container mount portion 73, the toner container TC, and the toner feeder 74 are installed in the process cartridge CR. The process cartridge CR is removably mounted on an apparatus body 1A of the image forming apparatus 1. The process cartridge CR corresponds to an example of a cartridge. The apparatus body 1A corresponds to an example of a housing. The toner container TC from among components installed in the process cartridge CR is removably mounted on the process cartridge CR. A component not including the toner container TC from among the components installed in the process cartridge CR, i.e., the toner-image forming and holding section 10, the cleaner 71, the recovery toner housing box 72, the container mount portion 73, and the toner feeder 74 are installed in a drum unit DU. The drum unit DU corresponds to an example of an image holding portion. In this exemplary embodiment, a direction in which the process toner cartridge CR is mounted on the apparatus body 1A is called mounting direction J, and a direction opposite to the mounting direction J is called removing direction K. Also, two directions including the mounting direction J and the removing direction K are collectively called mounting and removing directions JK. The process cartridge CR includes a handle 76. The operator grips the handle 76 when the operator removes or mounts the process cartridge CR from or on the apparatus body 1A. A specific structure of the process cartridge CR and a specific structure relating to mounting and removal of the toner container TC on and from the process cartridge CR will be described later.

Basic Operation of Image Forming Apparatus

A basic operation of the image forming apparatus 1 shown in FIG. 1 is described.

In the toner-image forming and holding section 10, the photoconductor drum 11 is rotationally driven in the direction indicated by arrow a and the charging unit 12 applies an electric charge to the surface of the photoconductor drum 11. The exposure unit 20 radiates the surface of the photoconductor drum 11 with exposure light based on an image signal provided from the outside, to form an electrostatic latent image on the surface of the photoconductor drum 11. The photoconductor drum 11 rotates while holding the electrostatic latent image.

The developing unit 13 develops the electrostatic latent image on the photoconductor drum 11 with the toner, to form a toner image. The toner feeder 74 feeds the toner to the developing unit 13 from the toner container TC. The photoconductor drum 11 rotates while holding to toner image formed by the developing unit 13.

A sheet P housed in any of the sheet housing portions 61, 62, and 63 is picked up by the pickup rollers 31, and transported along the transport path R to the transfer unit 40 by the separation roller 32 and the registration rollers 33. The sheet P is fed by the registration rollers 33 to the transfer unit 40 at a timing corresponding to a timing at which the toner image is formed on the photoconductor drum 11. The transfer unit 40 applies a bias voltage for transfer between the photoconductor drum 11 and the sheet, to transfer the toner image on the photoconductor drum 11, onto the sheet. The sheet with the toner image transferred by the transfer unit 40 is transported to the fixing unit 50. The fixing unit 50 fixes the transferred toner image to the sheet. In this way, the image is formed on the sheet. The sheet with the image formed thereon is output onto the output tray 83 by the output rollers 34.

After the transfer by the transfer unit 40, the cleaner 71 removes the toner remaining on the photoconductor drum 11. The toner removed from the photoconductor drum 11 by the cleaner 71 is housed in the recovery toner housing box 72.

Mounting and Removable of Process Cartridge

Figure 3:
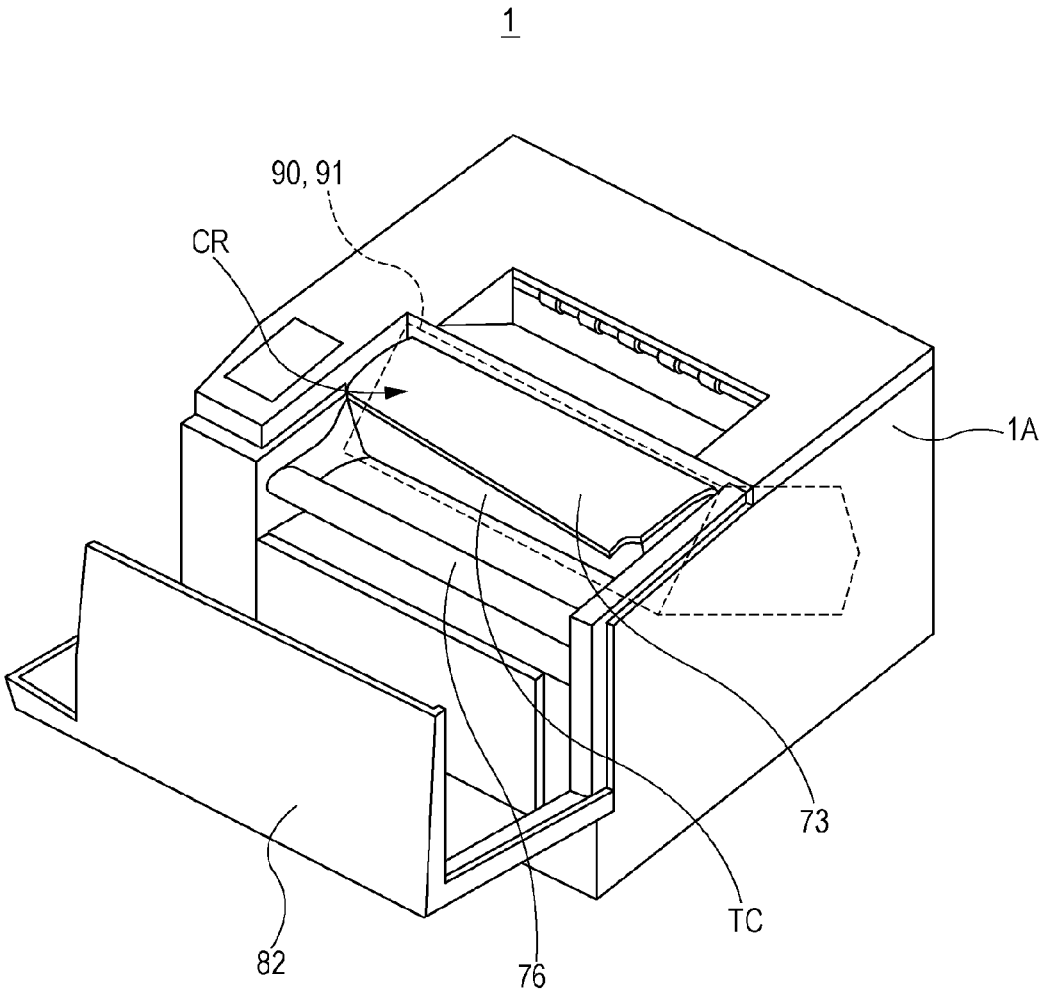
FIG. 3 is a perspective view showing a state in which a panel of the image forming apparatus shown in FIG. 2 is open.

FIG. 3 is a perspective view showing a state in which a panel of the image forming apparatus shown in FIG. 2 is open.

Description is continuously provided with reference to FIGS. 3 and 1. The process cartridge CR is exposed to the outside of the image forming apparatus 1 when the panel 82 that covers the front surface and upper surface of the image forming apparatus 1 is opened in the forward direction F. To be more specific, when the panel 82 is opened, the container mount portion 73, the toner container TC, and the handle 76 of the drum unit DU from among the components of the process cartridge CR are exposed. The process cartridge CR is arranged in a cavity provided in a mount portion 90 of the apparatus body 1A. The cavity of the mount portion 90 has a mount opening 91 that is open to the obliquely upper side in the forward direction F of the apparatus body 1A of the image forming apparatus 1.

Figure 4:
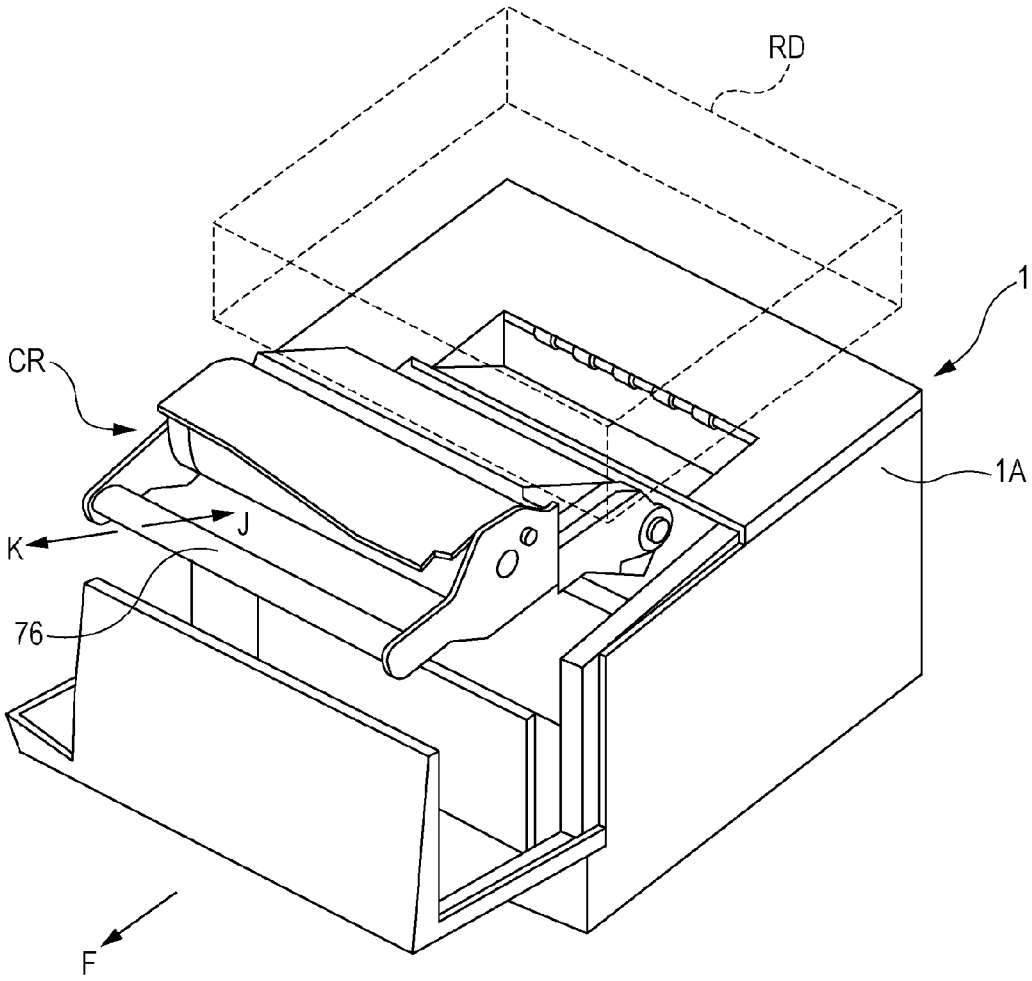
FIG. 4 is a perspective view showing a state in the middle of removal of the process cartridge.

FIG. 4 is a perspective view showing a state in the middle of removal of the process cartridge. FIG. 4 illustrates an arrangement position of an image reading device RD indicated by broken lines. The image reading device RD may be arranged above the image forming apparatus 1. The image reading device RD is a device that reads an image from a document. The image reading device RD provides read image data to the image forming apparatus 1, so that the image forming apparatus 1 functions as, for example, a copier.

When the operator grips and pulls the handle 76, the process cartridge CR is pulled from the apparatus body 1A of the image forming apparatus 1 to the obliquely upper side in the forward direction F, i.e., in the removing direction K. If the image reading device RD is arranged above the image forming apparatus 1, a space for removal of sheets is provided between the image forming apparatus 1 and the image reading device RD. When the process cartridge CR is removed or mounted, the process cartridge CR moves in the space for removal of sheets between the image forming apparatus 1 and the image reading device RD.

Configuration of Process Cartridge

Figure 5:
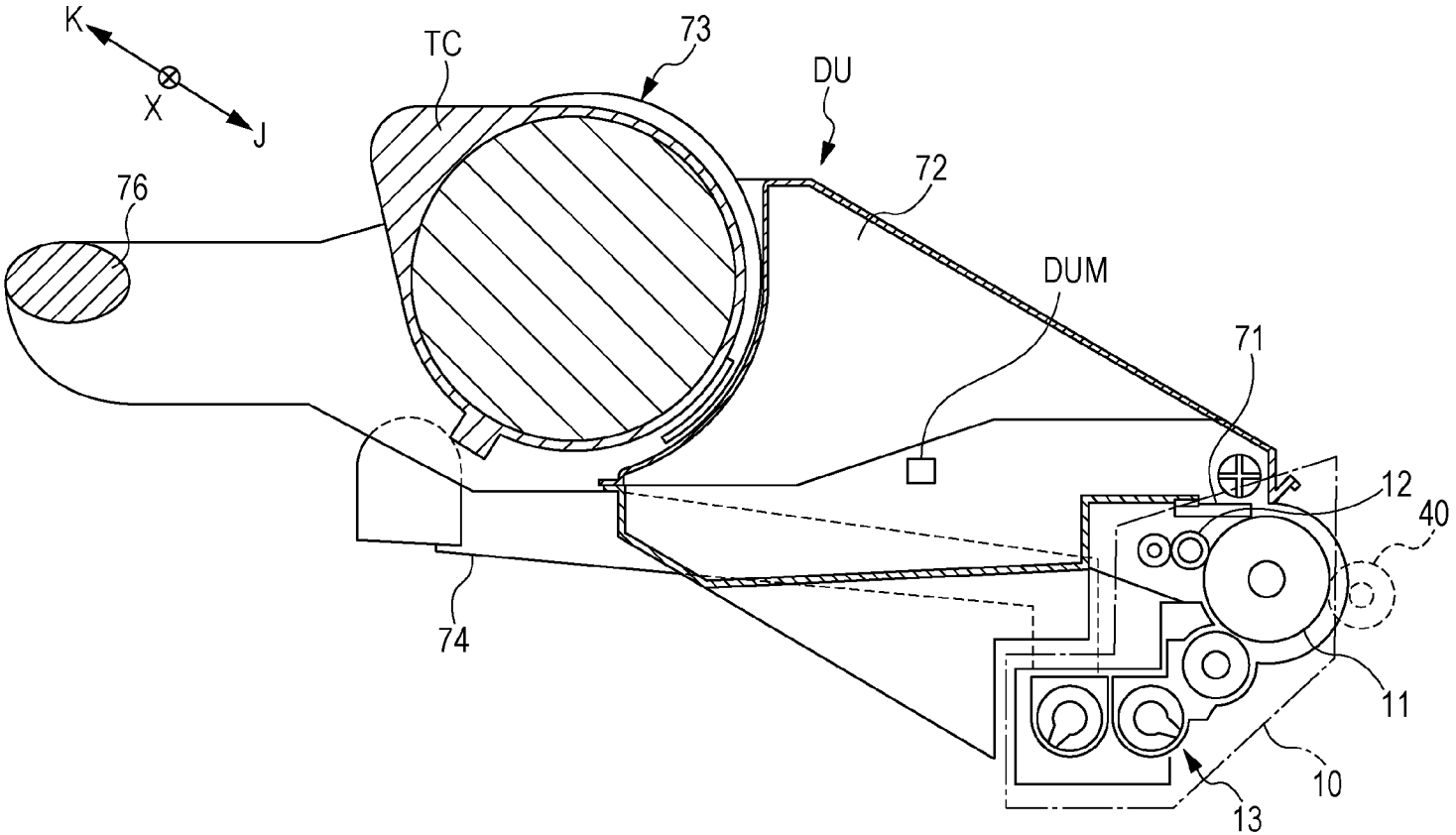
FIG. 5 is a cross-sectional view showing a configuration of the process cartridge.
Figure 6:
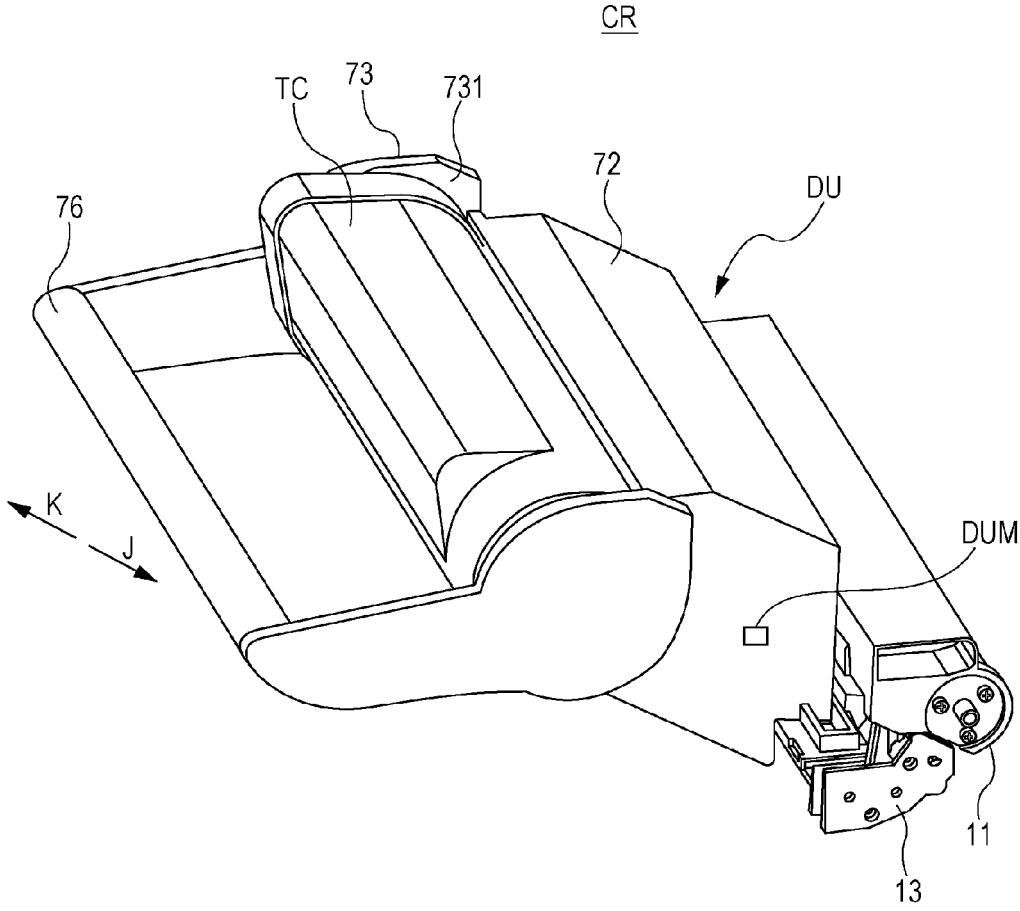
FIG. 6 is a perspective view showing an appearance of the process cartridge.

FIG. 5 is a cross-sectional view showing a configuration of the process cartridge. FIG. 6 is a perspective view showing an appearance of the process cartridge.

FIG. 5 also illustrates using broken lines the position of the transfer unit 40 while the process cartridge CR is mounted on the apparatus body 1A (see FIG. 1) of the image forming apparatus 1. The process cartridge CR shown in FIG. 6 is in a state in which the process cartridge CR is removed from the apparatus body 1A.

The process cartridge CR is a replacement unit in which the toner container TC and the drum unit DU are integrated as a unit. The drum unit DU includes the toner-image forming and holding section 10, the cleaner 71, the recovery toner housing box 72, the container mount portion 73, the toner feeder 74, and the handle 76. The toner-image forming and holding section 10 includes the photoconductor drum 11, the charging unit 12, and the developing unit 13 as described above.

In the process cartridge CR, the toner-image forming and holding section 10, the recovery toner housing box 72, and the toner container TC are arranged in the mounting and removing directions JK of the process cartridge CR, and the recovery toner housing box 72 extends in the space between the toner container TC and the toner-image forming and holding section 10. While the process cartridge CR is mounted on the apparatus body 1A, the toner container TC mounted on the container mount portion 73 is located at the most rear position in the mounting direction J. In other words, while the process cartridge CR is mounted on the apparatus body 1A, the toner container TC of the process cartridge CR is arranged at the most front position in the mount portion 90 of the apparatus body 1A of the image forming apparatus 1. Hence, while the panel 82 of the apparatus body 1A is open as shown in FIG. 3, the toner container TC from among the components of the process cartridge CR is exposed to the outside.

A unit memory DUM is installed on a side surface of the recovery toner housing box 72 of the drum unit DU. The unit memory DUM stores toner remaining amount information indicative of a remaining amount of the toner in the toner container TC and drum cumulative use information indicative of a cumulative use amount of the photoconductor drum 11 of the drum unit DU. The unit memory DUM corresponds to an example of a storage. Also, the toner remaining amount information corresponds to an example of first information, and the drum cumulative use information corresponds to an example of second information.

While the process cartridge CR is arranged at the mount portion 90 of the apparatus body 1A, the unit memory DUM installed on the drum unit DU is positioned to face an inner surface of the mount portion 90. A connection terminal is provided at an outer surface of the unit memory DUM. A connection terminal that comes into contact with the connection terminal of the unit memory DUM is provided at the inner surface of the mount portion 90. While the process cartridge CR is mounted on the mount portion 90, the connection terminals come into contact with each other and hence are electrically connected with each other. Thus, the unit memory DUM is connected with the controller 1C of the image forming apparatus 1 (see FIG. 1). The controller 1C is able to write and read the toner remaining amount information and the drum cumulative use information in and from the unit memory DUM.

Toner Container and Container Mount Portion

Figure 7:
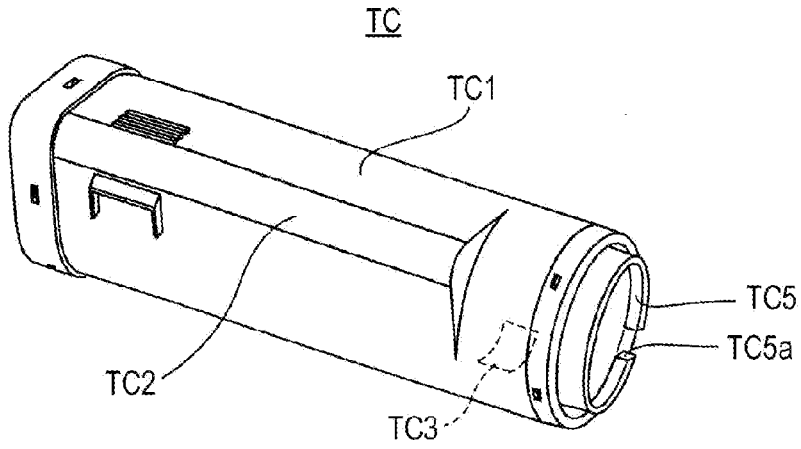
FIG. 7 is a perspective view showing a toner container.
Figure 8:
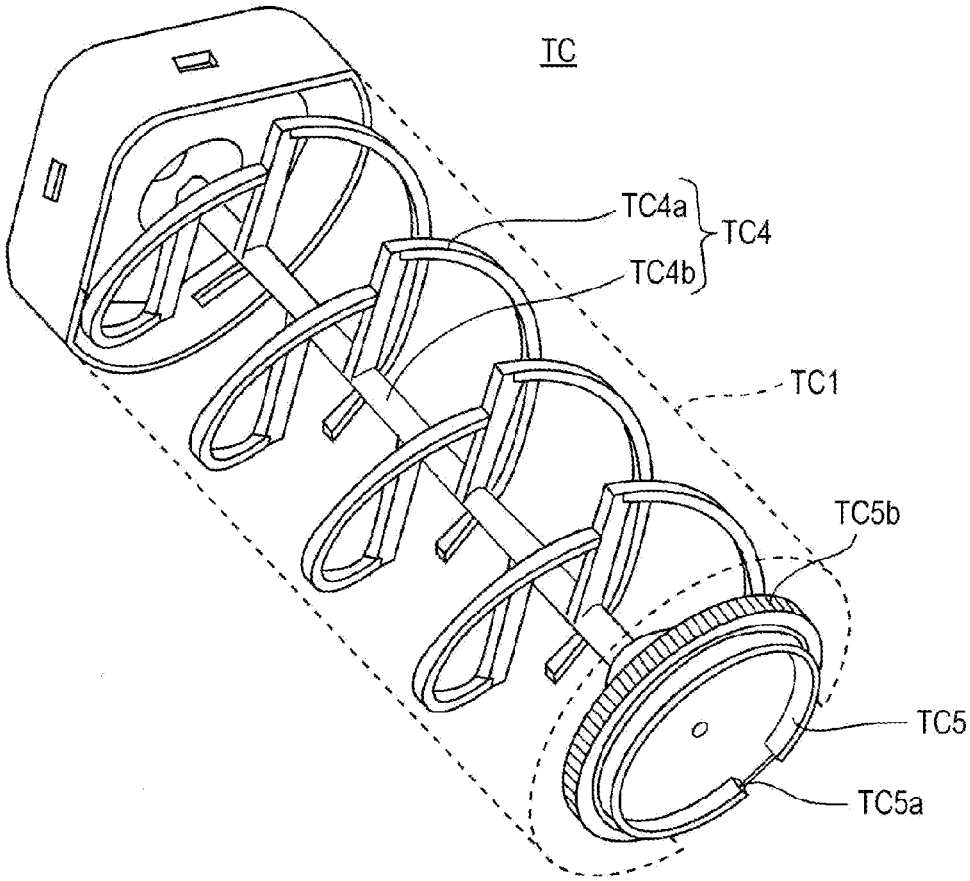
FIG. 8 is a perspective view showing an inner configuration of the toner container shown in FIG. 7.

FIG. 7 is a perspective view showing the toner container. FIG. 8 is a perspective view showing an inner configuration of the toner container shown in FIG. 7.

The toner container TC shown in FIG. 7 has a housing TC1 having a cylindrical shape with a peripheral surface and a bottom. A protrusion TC2 indicative of the direction of the toner container TC is provided at part of the peripheral surface. A toner is housed in the toner container TC. A panel TC3 that closes a path of the toner is provided at the peripheral surface of the toner container TC. Also, as shown in FIG. 8, a transport member TC4 is provided in the toner container TC. The transport member TC4 includes a linear part TC4*a* extending in a spiral shape and a shaft part TC4*b* holding the linear part TC4*a*. The transport member TC4 is held rotatably with respect to the housing TC1. The shaft part TC4*b* protrudes outside the toner container TC. The protruding shaft part TC4*b* is provided with power of a driving stepping motor M (described later). The transport member TC4 is rotated by this power around the shaft part TC4*b*, and transports the toner toward the panel TC3 by this rotation.

Also, a restraining member TC5 that restrains the toner container TC with respect to the container mount portion 73 is provided. The restraining member TC5 is a ring-like member having a notch TC5*a*. The restraining member TC5 is fixed to the shaft part TC4*b* of the transport member TC4 and rotates together with the transport member TC4. The combination of the transport member TC4 and the restraining member TC5 corresponds to an example of a supply mechanism.

The toner container TC is mounted on the container mount portion 73 of the drum unit DU shown in FIG. 5, and hence is mounted on the process cartridge CR as described above.

Figure 9:
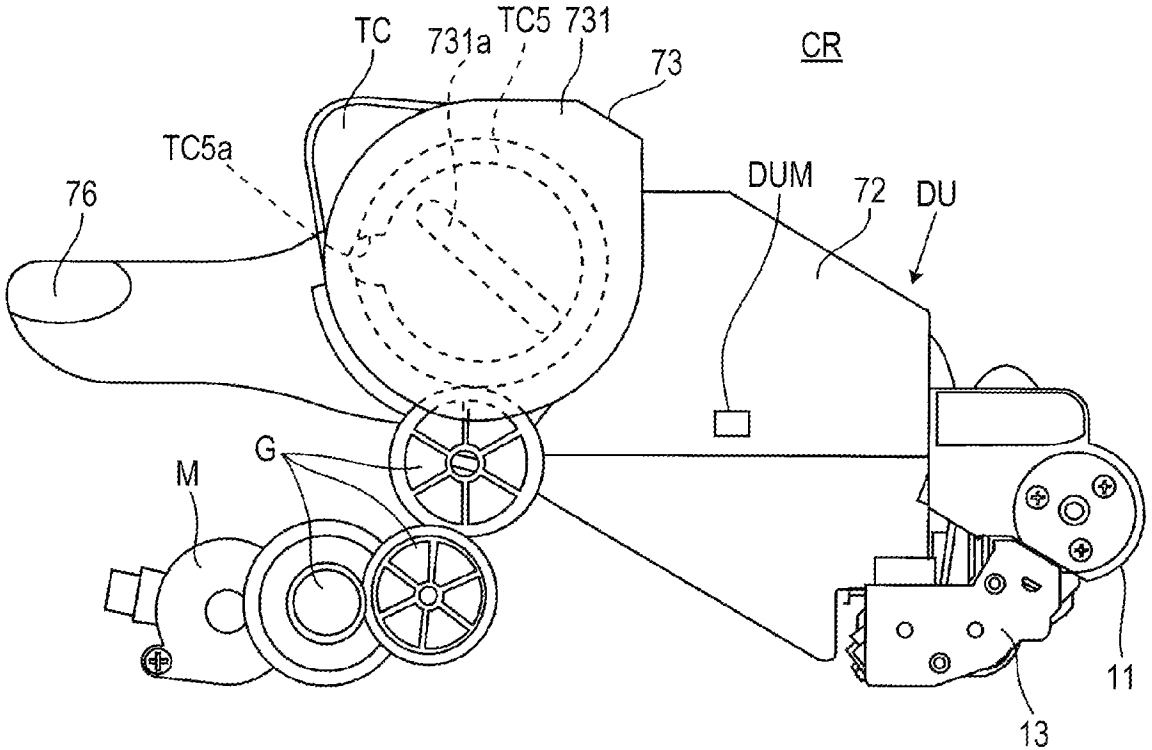
FIG. 9 is a partly perspective side view showing the process cartridge, FIG. 9 illustrating in a perspective manner the toner container and a container mount portion from among components installed in the process cartridge.

FIG. 9 is a partly perspective side view showing the process cartridge, FIG. 9 illustrating in a perspective manner the toner container and the container mount portion from among the components installed in the process cartridge. The process cartridge CR shown in FIG. 9 is in a state in which the process cartridge CR is arranged in the cavity provided in the mount portion 90 (see FIG. 1) of the apparatus body 1A although the cavity is not illustrated in FIG. 9. Also, FIG. 9 illustrates the driving stepping motor M and a driving transmission gear G included in the apparatus body 1A.

The apparatus body 1A includes the driving stepping motor M and the driving transmission gear G. The rotation of the driving stepping motor M is controlled by the controller 1C. The driving transmission gear G transmits power of the driving stepping motor M to the restraining member TC5 and consequently transmits the power to the transport member TC4. The restraining member TC5 includes teeth TC5*b* (see FIG. 8) that mesh with the driving transmission gear G. The restraining member TC5 and the driving transmission gear G mesh with each other when the process cartridge CR is inserted into the mount portion 90. When the driving stepping motor M is driven, the restraining member TC5 and the transport member TC4 are rotated via the driving transmission gear G. Although not shown, the aforementioned blade member 74*a* of the toner feeder 74 is also rotated when receiving the power of the driving stepping motor M.

The container mount portion 73 includes a fixing member 731 that is fixed to the recovery toner housing box 72 and the handle 76 that is fixed to the fixing member 731. The fixing member 731 has a linearly extending protrusion 731*a* provided at an inner side surface of the fixing member 731. The protrusion 731*a* guides the notch TC5*a* when the toner container TC is mounted and removed. The toner container TC is housed inside the fixing member 731.

When the operation of the image forming apparatus 1 is stopped while the toner container TC is not empty, although described later in detail, the notch TC5*a* of the restraining member TC5 is stopped at a position different from a position at a deep side of the apparatus on the extension line of the linearly extending protrusion 731*a* (hereinafter, this position is referred to as release position) by rotation control of the driving stepping motor M. Hence, the toner container TC is in a locked state in which the toner container TC is retained in the container mount portion 73 and is not able to be removed from the container mount portion 73. That is, the combination of the fixing member 731 and the restraining member TC5 corresponds to an example of a retaining mechanism.

When the toner container TC becomes empty, although described later in detail, the notch TC5*a* of the restraining member TC5 is stopped at the release position by the rotation control of the driving stepping motor M. As the result, the toner container TC is allowed to be removed from the process cartridge.

Figure 10:
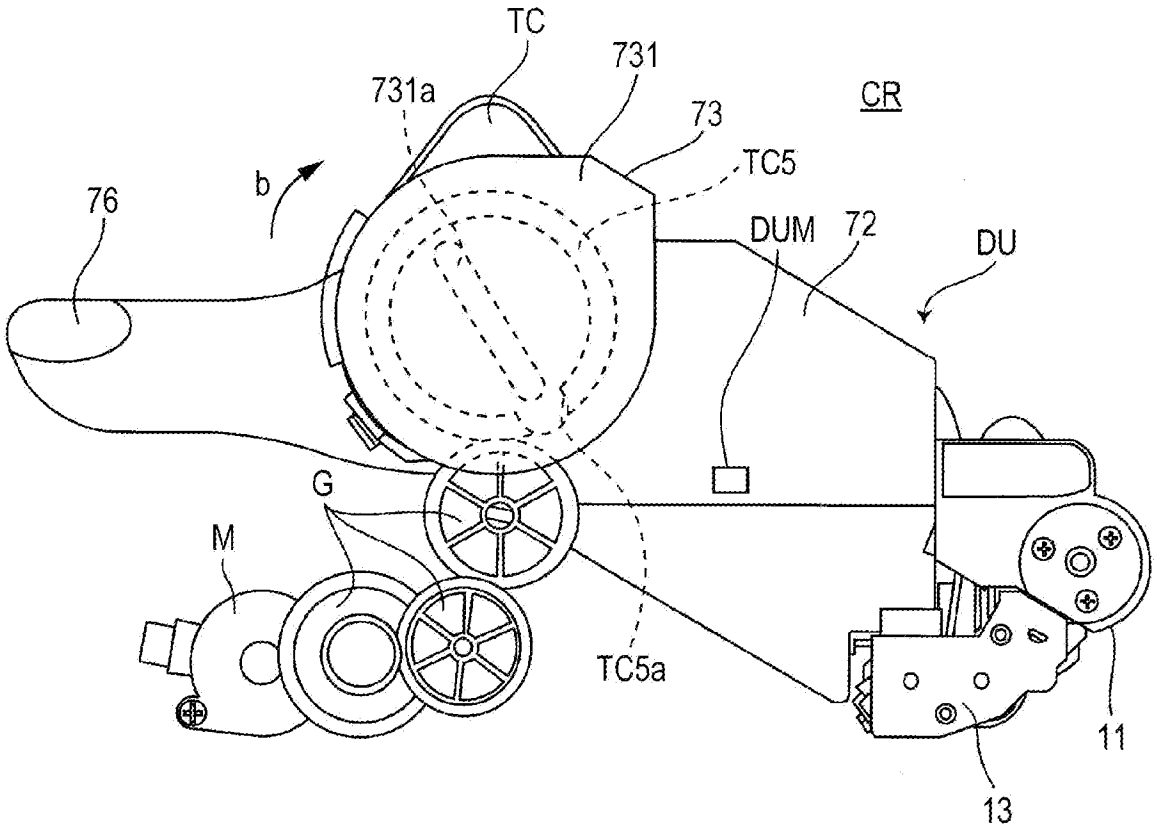
FIG. 10 is a partly perspective side view showing the process cartridge in a state in which the toner container is allowed to be removed from the process cartridge.

FIG. 10 is a partly perspective side view showing the process cartridge in the state in which the toner container is allowed to be removed from the process cartridge. FIG. 10 illustrates in a perspective manner the toner container TC and the container mount portion 73 from among the components installed in the process cartridge CR like FIG. 9. The process cartridge CR shown in FIG. 10 is in the state in which the process cartridge CR is arranged in the cavity provided in the mount portion 90 (see FIG. 1) of the apparatus body 1A although the cavity is not illustrated in FIG. 10 like FIG. 9. Also, like FIG. 9, FIG. 10 illustrates the driving stepping motor M and the driving transmission gear G included in the apparatus body 1A.

The direction of the toner container TC shown in FIG. 10 is a direction when the operator rotates the toner container TC in a direction indicated by arrow b from the direction shown in FIG. 9. During the operation by the operator, since the restraining member TC5 meshes with the driving transmission gear G, the notch TC5*a* of the restraining member TC5 is located at the release position even if the direction of the toner container TC is changed. In other words, the toner container TC is in a state in which the toner container TC is allowed to be removed from the container mount portion 73 while the notch TC5*a* of the toner container TC is guided by the protrusion 731*a*. The rotation of the toner container TC by the operation of the operator is rotation for closing the path of the toner with the panel TC3 shown in FIG. 7. This rotation is detected by the controller 1C through a detecting mechanism (not shown). The controller 1C judges the replacement of the toner container TC through the detection.

Figure 11:
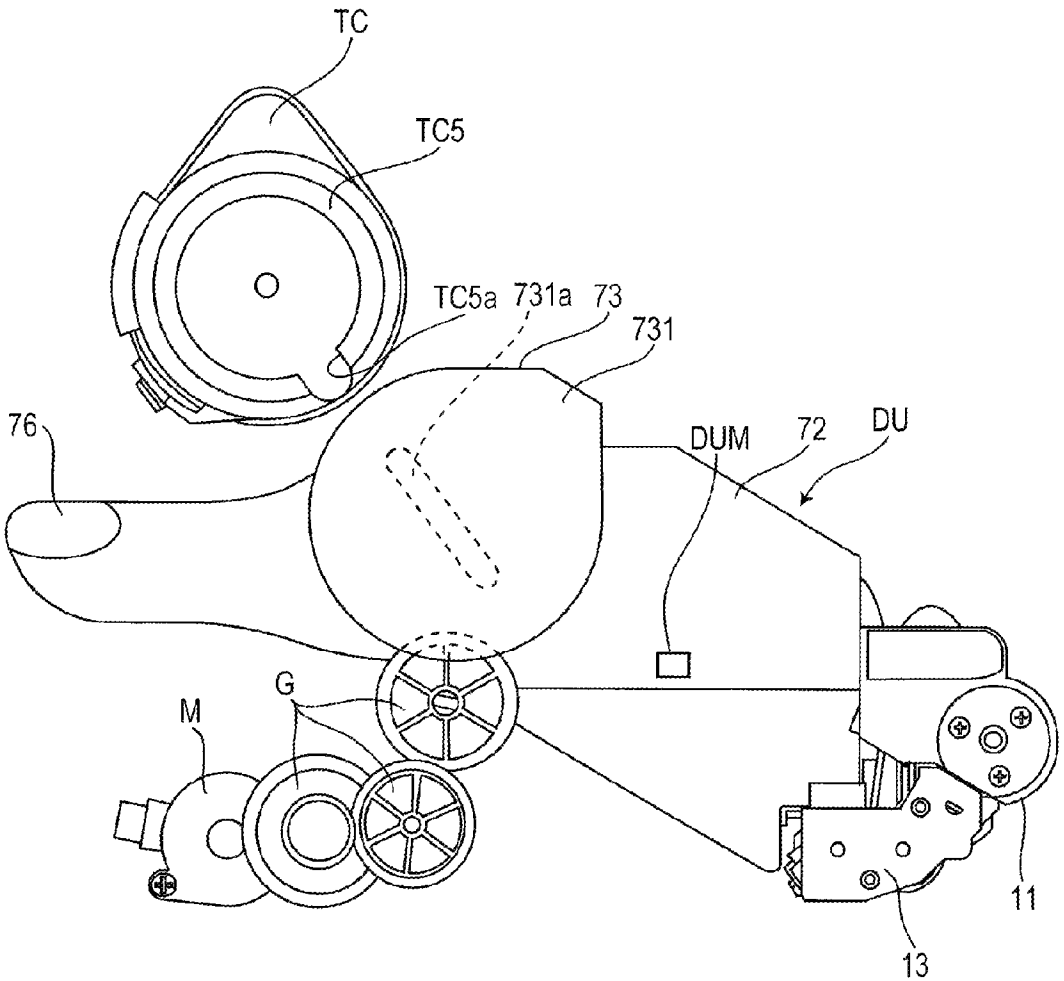
FIG. 11 is a partly perspective side view showing the process cartridge while the toner container is removed from the process cartridge.

FIG. 11 is a partly perspective side view showing the process cartridge while the toner container is removed from the process cartridge. FIG. 11 illustrates in a perspective manner the container mount portion 73 from among the components installed in the process cartridge CR. The drum unit DU of the process cartridge CR shown in FIG. 10 is in a state in which the drum unit DU is arranged at the mount portion 90 (see FIG. 1) of the apparatus body 1A although not shown in FIG. 10. Also, like FIGS. 9 and 10, FIG. 11 illustrates the driving stepping motor M and the driving transmission gear G included in the apparatus body 1A.

As shown in FIG. 11, the toner container TC is removed from the process cartridge CR while the drum unit DU remains in the apparatus body 1A (see FIG. 1). Alternatively, the toner container TC may be removed such that the process cartridge is removed from the apparatus body 1A (see FIG. 1) in the state shown in FIG. 10 and then the toner container TC is removed from the removed process cartridge CR.

As described with reference to FIGS. 9 to 11, with the image forming apparatus 1 according to this exemplary embodiment, the toner container TC is allowed to be removed from the process cartridge CR only if the sensor 134 detects that the toner container TC is empty. In other words, if the toner container TC is not empty, the toner container TC is inhibited from being removed from the process cartridge CR.

Operation of Controller for Toner Feed

Figure 12:
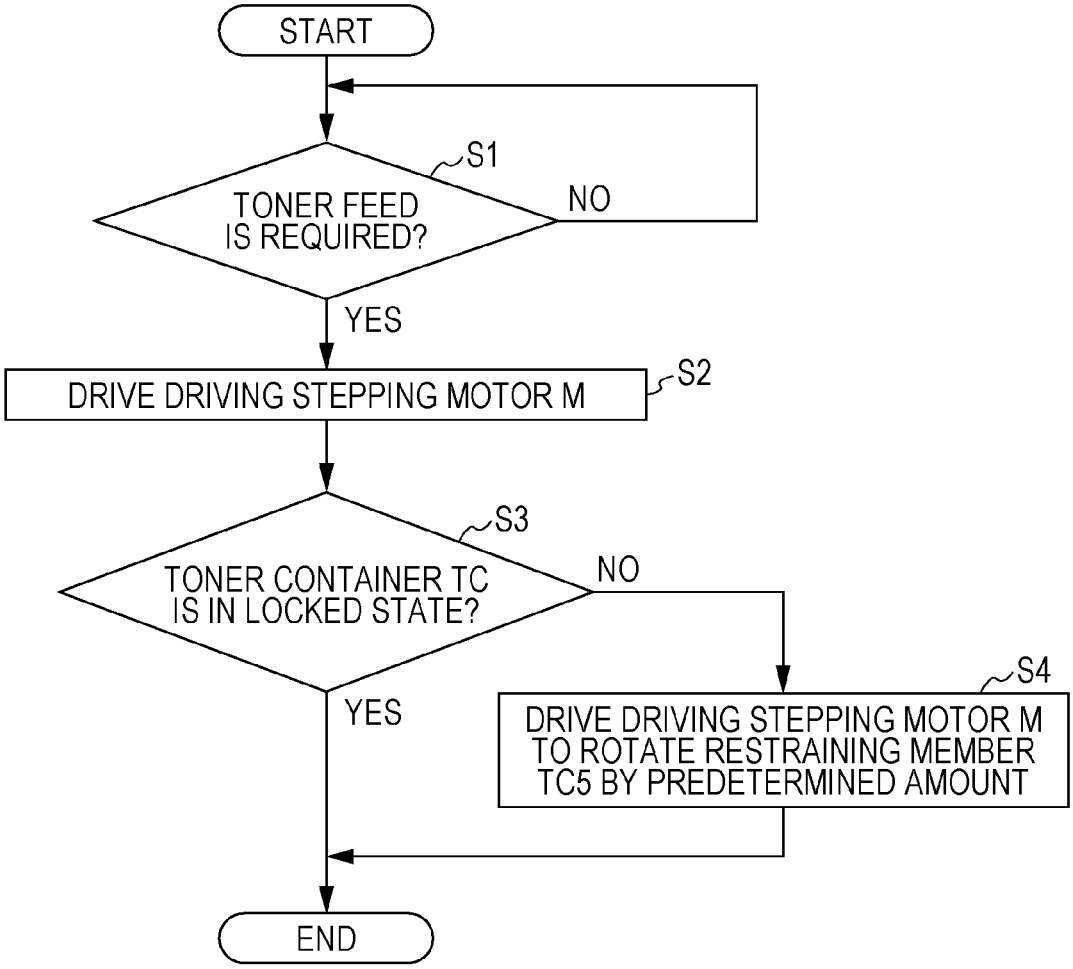
FIG. 12 is a flowchart showing an operation of a controller for feeding a toner.

FIG. 12 is a flowchart showing an operation of a controller for feeding a toner.

The operation indicated by this flowchart is an operation that is started every time when an image is formed and that is executed by the controller 1C. When this operation is started, the controller 1C judges whether or not the toner housed in the toner container TC is required to be fed to the developing unit 13 based on the toner ratio indicated by the sensor 134 (step S1). If it is judged that the toner feed is required in step S1, the controller 1C drives the driving stepping motor M to rotate the transport member TC4 of the toner container TC and the blade member 74*a* of the toner feeder 74 by predetermined amounts (step S2). Accordingly, the toner housed in the toner container TC is fed to the developing unit 13. When the toner is fed, the controller 1C updates the toner remaining amount information stored in the unit memory DUM. If the toner remaining amount information is updated and becomes toner remaining amount information corresponding to that the toner container TC is almost empty, the controller 1C causes the display screen 84 to display a message for notifying the operator that the time of replacement of the toner container TC is getting close. The operator of the image forming apparatus 1 sees the message displayed on the display screen 84, and hence prepares a toner container TC. However, the toner container TC is replaced when it is detected that the toner container TC is empty, which will be described later.

Also, the controller 1C updates the drum cumulative use information stored in the unit memory DUM every time when an image is formed regardless of whether or not the toner is fed.

After the toner is fed to the developing unit 13 in step S2, the, the controller 1C judges whether or not the notch TC5*a* of the restraining member TC5 is shifted from the release position when the rotation of the transport member TC4 is stopped, based on calculation using the number of pulses of the driving stepping motor M (step S3).

If it is judged that the notch TC5*a* is stopped at the release position in step S3, the controller 1C drives the driving stepping motor M to rotate the restraining member TC5 so that the notch TC5*a* is located at a position different from the release position (step S4).

Operation of Controller for Replacement of Process Cartridge

Figure 13:
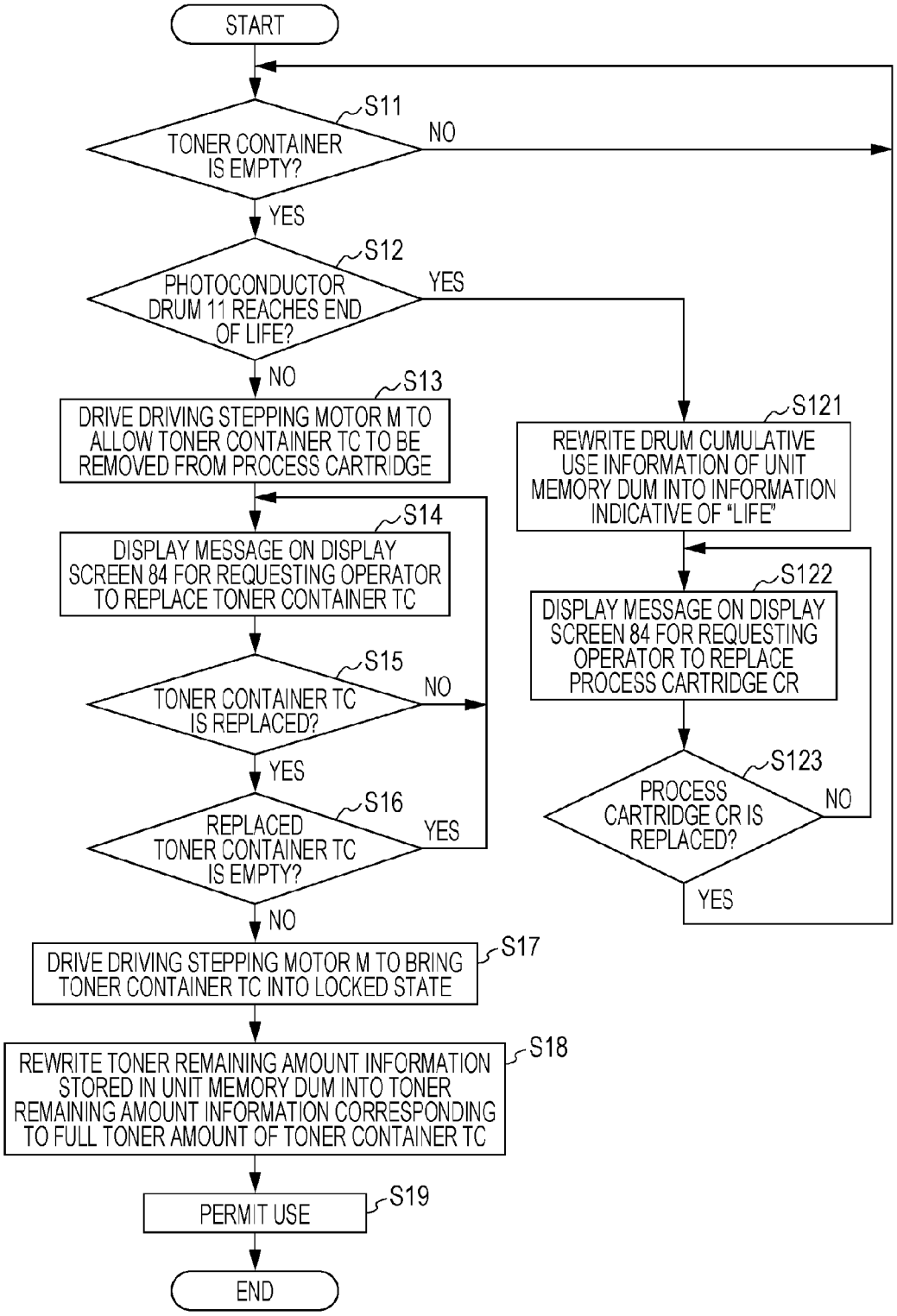
FIG. 13 is a flowchart showing an operation of a controller for replacing the process cartridge.

FIG. 13 is a flowchart showing an operation of a controller for replacing the process cartridge.

The operation indicated by this flowchart is an operation that is executed in parallel to the aforementioned operation described in the flowchart in FIG. 12.

When the operation indicated by this flowchart is started, the controller 1C detects whether or not the toner ratio indicated by the sensor 134 installed on the developing unit 13 is the aforementioned predetermined ratio or lower, i.e., the controller 1C detects whether or not the toner container TC is empty (step S11). Image formation is continued by the operation of the operator and the toner is appropriately fed by the operation described in the flowchart in FIG. 12 unless it is detected that the toner container TC is empty in step S11. The toner remaining amount information and the drum cumulative use information are appropriately updated.

If it is detected that the toner container TC is empty in step S11, the controller 1C reads the drum cumulative use information in the unit memory DUM and judges whether or not the read drum cumulative use information becomes drum cumulative use information corresponding to that the life of the photoconductor drum 11 reaches its end (step S12).

If it is judged that the read drum cumulative use information does not become the drum cumulative use information corresponding to that the life of the photoconductor drum 11 reaches its end in step S12, the controller 1C controls the rotation of the driving stepping motor M, rotates the restraining member TC5 and then stops the restraining member TC5 so that the notch TC5*a* of the restraining member TC5 is located at the release position. Accordingly, the toner container TC is allowed to be removed from the container mount portion 73 (step S13). Also, the controller 1C causes the display screen 84 to display a message for requesting the operator to replace the toner container TC (step S14).

If it is detected that the toner container TC is replaced with another one by the operator independently from the process cartridge CR through the aforementioned detecting mechanism (step S15), the controller 1C detects whether or not the replaced toner container TC is empty by the sensor 134 installed on the developing unit 13 (step S16) in a manner similar to step S11.

If is detected that the replaced toner container TC is empty in step S16, the operation returns to step S14.

In contrast, if it is detected that the replaced toner container TC is not empty in step S16, the controller 1C rotates the restraining member TC5 and then stops the restraining member TC5 so that the notch TC5*a* of the restraining member TC5 is located at a position different from the release position by the rotation control of the driving stepping motor M. Hence, the toner container TC is in a locked state in which the toner container TC is retained in the container mount portion 73 and is not able to be removed from the container mount portion 73 (step S17).

If the toner container TC is retained in the container mount portion 73 in step S17 as described above, this represents that the toner container TC is replaced with new one. The controller 1C rewrites the toner remaining amount information stored in the unit memory DUM into toner remaining amount information corresponding into the full toner amount of the toner container TC (step S18). Then, the use of the process cartridge CR is permitted (step S19).

If it is judged that the read drum cumulative use information becomes the drum cumulative use information corresponding to that the life of the photoconductor drum 11 reaches its end in step S12, the controller 1C rewrites the drum cumulative use information in the unit memory DUM into information indicative of "life" (step S121). Also, the controller 1C causes the display screen 84 to display a message for requesting the operator to replace the process cartridge CR (step S122). The operator sees the message and replaces the process cartridge CR with a new process cartridge CR. The controller 1C detects the replacement of the process cartridge CR by monitoring the drum cumulative use information in the unit memory DUM.

If it is detected that the process cartridge CR is replaced by the operator (step S123), the operation returns to step S11. As described above, image formation is continued through an operation by the operator unless it is detected that the toner container TC is empty.

Next, another exemplary embodiment of the invention is described. The configuration and the operation of this exemplary embodiment are similar to those of the above-described exemplary embodiment except that a cartridge memory is installed on the toner container TC instead of the unit memory DUM installed on the drum unit DU, a body memory is included in the image forming apparatus 1, and the operation of the controller 1C when the toner container TC is replaced is an operation depending on these memories. Hereinafter, different points are described.

General Configuration of Image Forming Apparatus (Another Exemplary Embodiment)

Figure 14:
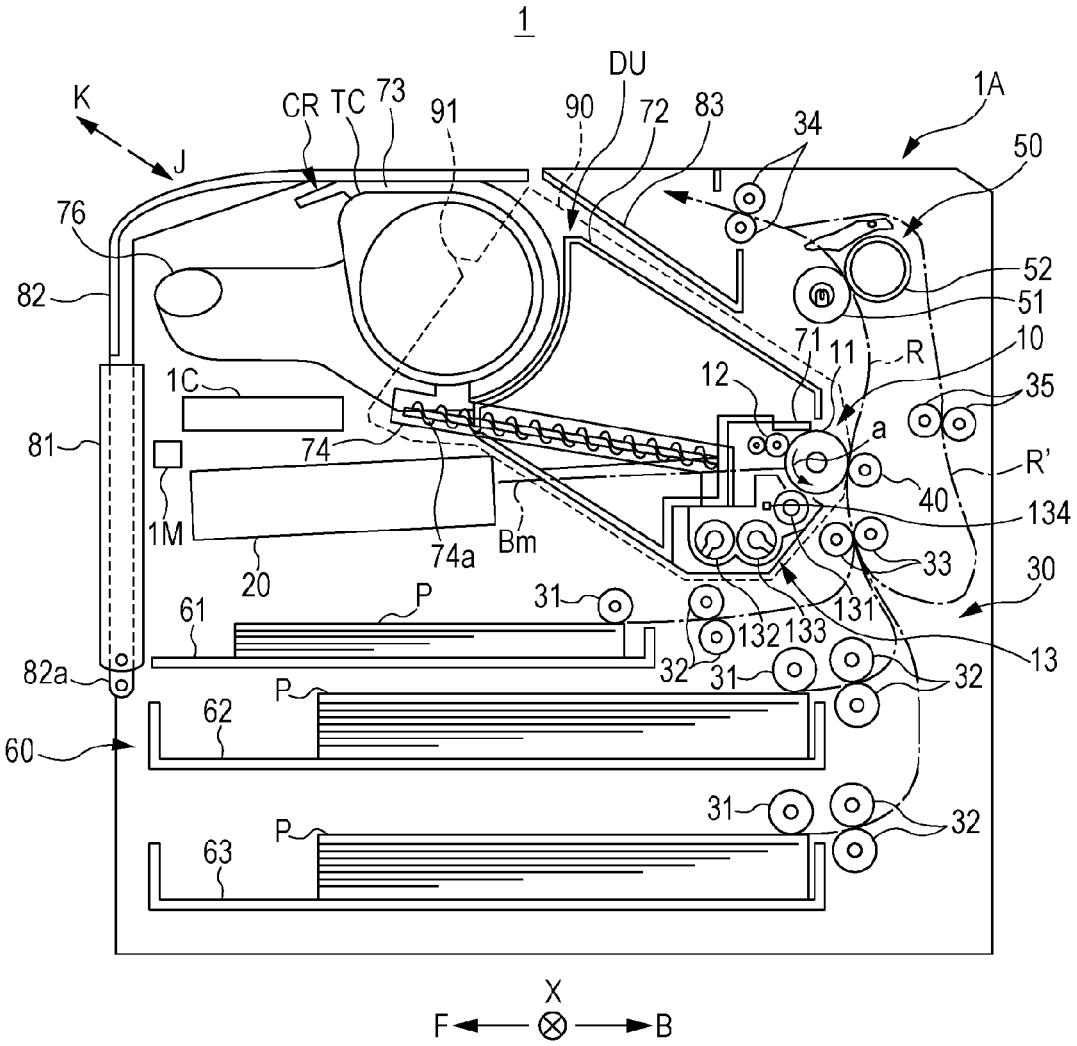
FIG. 14 is a cross-sectional view showing a general configuration of an image forming apparatus according to another exemplary embodiment of the invention.

FIG. 14 is a cross-sectional view showing a general configuration of an image forming apparatus according to another exemplary embodiment of the invention.

The image forming apparatus 1 includes a body memory 1M.

The body memory 1M is a memory installed on the apparatus body 1A of the image forming apparatus 1. The body memory 1M stores drum cumulative use information indicative of a cumulative use amount of the photoconductor drum 11 in the drum unit DU. Although the detail will be described later, the body memory 1M corresponds to an example of a housing storage.

Toner Container and Container Mount Portion (Another Exemplary Embodiment)

Figure 15:
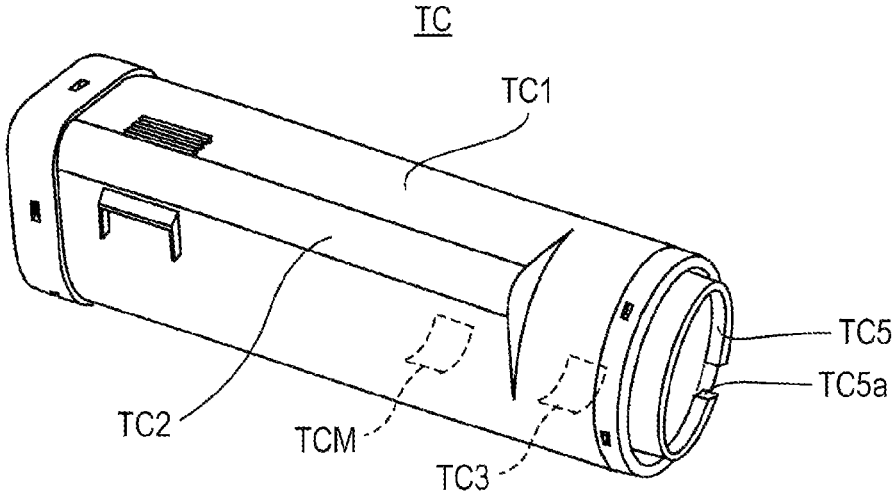
FIG. 15 is a perspective view showing a toner container according to another exemplary embodiment.

FIG. 15 is a perspective view showing a toner container according to another exemplary embodiment.

A cartridge memory TCM is installed on the peripheral surface of the toner container TC. The cartridge memory TCM stores toner remaining amount information indicative of a remaining amount of the toner in the toner container TC and drum cumulative use information indicative of a cumulative use amount of the photoconductor drum 11 of the drum unit DU. The cartridge memory TCM corresponds to an example of a container storage. Also, the toner remaining amount information corresponds to an example of first information, and the drum cumulative use information corresponds to an example of second information.

While the toner container TC is mounted on the container mount portion 73, the cartridge memory TCM installed on the toner container TC is located at a position at which the cartridge memory TCM faces the inner surface of the mount portion 90. A connection terminal is provided at the outer surface of the cartridge memory TCM. A connection terminal that comes into contact with the connection terminal of the cartridge memory TCM is provided at the inner surface of the mount portion 90. While the toner container TC is mounted on the container mount portion 73, the connection terminals come into contact with each other and hence are electrically connected with each other. Thus, the cartridge memory TCM is connected with the controller 1C of the image forming apparatus 1 (see FIG. 1). The controller 1C is able to write and read the toner remaining amount information and the drum cumulative use information in and from the cartridge memory TCM. The controller 1C controls the entire image formation operation of the image forming apparatus 1. The controller 1C updates the drum cumulative use information in the cartridge memory TCM every time when an image is formed. Also, the controller 1C writes the backup of the drum cumulative use information in the body memory 1M. Further, the controller 1C operates the toner feeder 74 if necessary to feed the toner to the developing unit 13 from the toner container TC, and updates the toner remaining amount information in the cartridge memory TCM every time when the toner is fed.

Operation of Controller for Replacement of Process Cartridge (Another Exemplary Embodiment)

Figure 16:
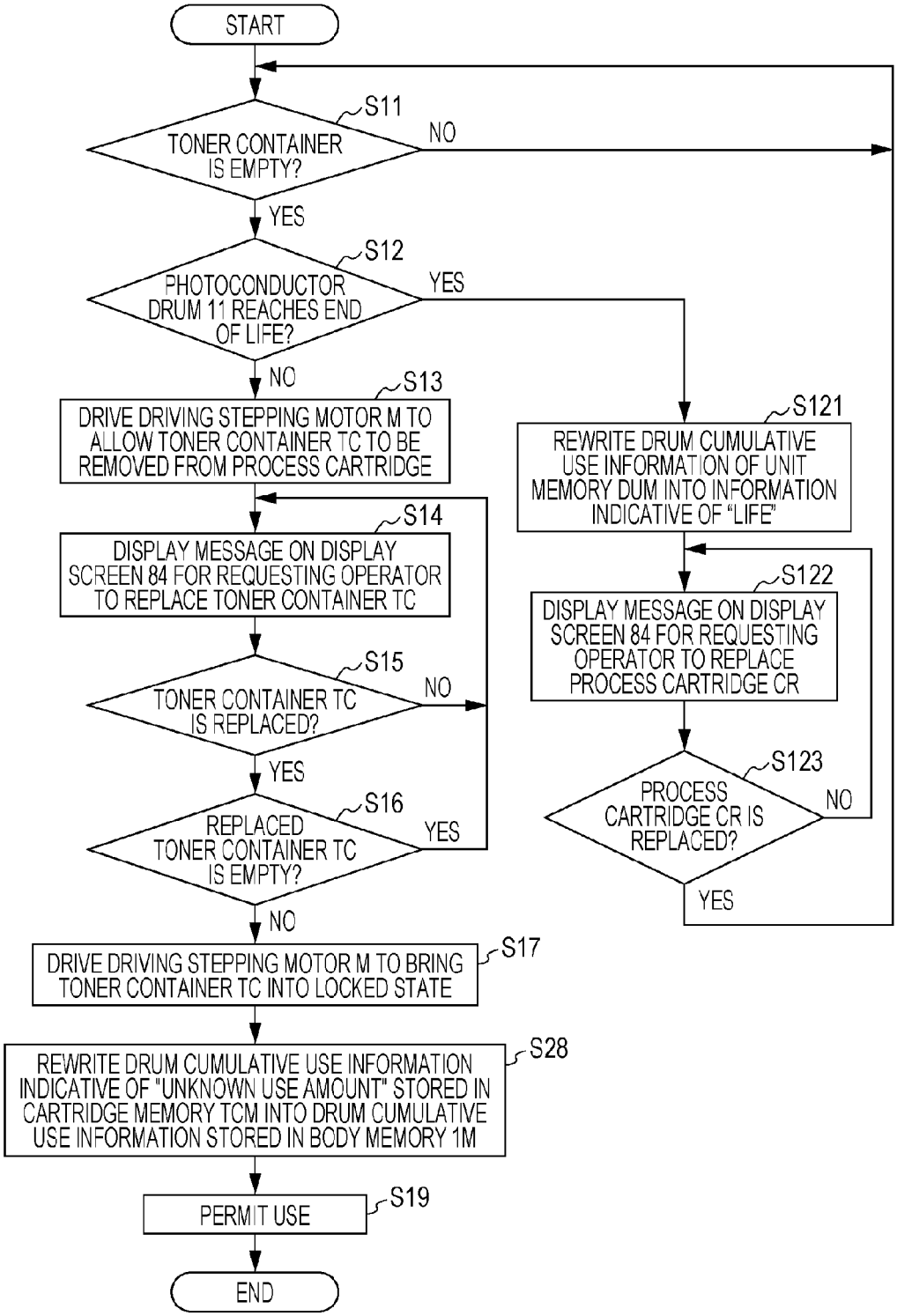
FIG. 16 is a flowchart showing an operation of a controller for replacing a process cartridge according to another exemplary embodiment.

FIG. 16 is a flowchart showing an operation of a controller for replacing a process cartridge according to another exemplary embodiment.

In this exemplary embodiment, if the toner container TC is retained in the container mount portion 73 in step S17, this represents that the toner container TC is replaced with new one. In this exemplary embodiment, the cartridge memory TCM is replaced with new one together with the toner container TC. Owing to this, the drum cumulative use information stored in the cartridge memory TCM is information indicative of "unknown use amount." Meanwhile, since the drum unit DU is in use (in a used state), proper drum cumulative use information has to be stored in the cartridge memory TCM. Hence, when the toner container TC is retained in the container mount portion 73 in step S17, the controller 1C rewrites the drum cumulative use information indicative of "unknown use amount" stored in the cartridge memory TCM into drum cumulative use information stored in the body memory 1M (step S28). Accordingly, the drum cumulative use information is correctly provided in the new cartridge memory TCM. Then, the use of the process cartridge CR is permitted (step S19).

In the above-described exemplary embodiments, the mechanism that inhibits the toner container TC from being removed from the process cartridge CR if the toner container TC is not empty is exemplarily provided by the combination of the restraining member TC5 provided on the side surface of the toner container TC and the protrusion 731*a* provided on the inner side surface of the fixing member 731 of the container mount portion 73 as described with reference to FIGS. 9 to 11. However, the mechanism is not limited thereto, and may be provided by an example described as follows. Hereinafter, different points are described. Mechanism that Inhibits Toner Container TC from being Removed from Process Cartridge CR if Toner Container TC is not Empty (Another Example)

Figure 17:
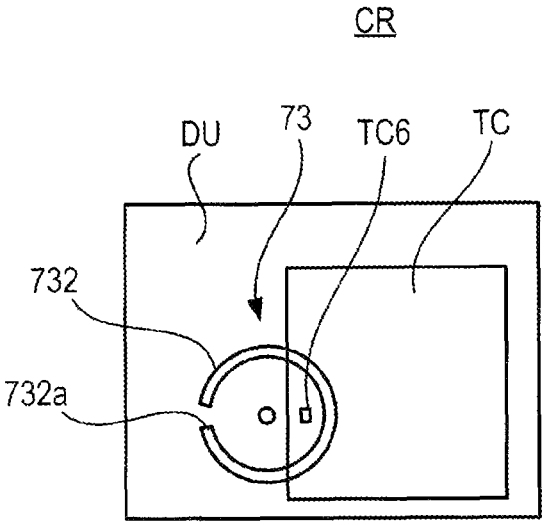
FIG. 17 is a schematic illustration showing a process cartridge according to another example.

FIG. 17 is a schematic illustration showing a process cartridge according to another example. The process cartridge CR shown in FIG. 17 is in a state in which the process cartridge CR is arranged at the mount portion 90 (see FIG. 1) of the apparatus body 1A although not shown.

A protrusion TC6 is provided on the side surface of the toner container TC shown in FIG. 17 instead of the above-described restraining member TC5.

Also, the container mount portion 73 of the drum unit DU shown in FIG. 17 includes a restraining member 732 that restrains the toner container TC with respect to the container mount portion 73 instead of the above-described protrusion 731*a*. The restraining member 732 is a ring-like member having a container guiding and holding notch 732*a* that guides and holds the protrusion TC6 of the toner container TC. The restraining member 732 is fixed to a shaft part of the blade member 74*a* of the toner feeder 74, and rotates together with the blade member 74*a*. To be more specific, the toner container TC is held by the container guiding and holding notch 732*a* while the toner container TC is mounted on the container mount portion 73, and the toner container TC is guided by the container guiding and holding notch 732*a* in the middle of the state in which the toner container TC is mounted on the container mount portion 73. Also, when the blade member 74*a* is rotated because the power of the driving stepping motor M (see FIG. 9) is transmitted to the blade member 74*a*, the restraining member 732 is also rotated with the rotation of the blade member 74*a*. The rotation of the driving stepping motor M is controlled by the controller 1C. The toner container TC is housed in the container mount portion 73 at the inner side with respect to the restraining member 732.

When the operation of the image forming apparatus 1 is stopped while the toner container TC is not empty, the restraining member 732 is stopped at a position different from a position at which the protrusion TC6 of the toner container TC is allowed to be guided by the container guiding and holding notch 732*a* (hereinafter, this position is referred to as release position) by rotation control of the driving stepping motor M. Hence, the toner container TC is in a locked state in which the toner container TC is retained in the container mount portion 73 and is not able to be removed from the container mount portion 73. That is, the combination of the protrusion TC6 and the restraining member 732 corresponds to an example of a retaining mechanism.

When the toner container TC becomes empty, although described later in detail, the restraining member 732 is stopped at the release position by the rotation control of the driving stepping motor M. As the result, the toner container TC is allowed to be removed from the process cartridge.

Figure 18:
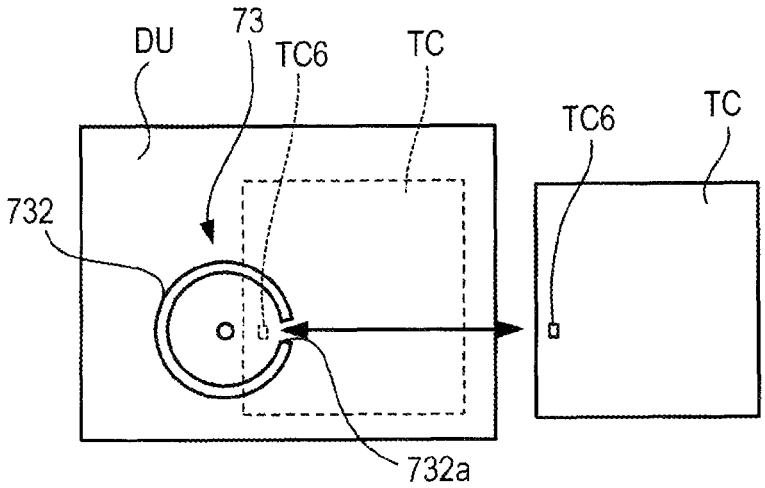
FIG. 18 is a schematic illustration showing the process cartridge according to another example in the state in which the toner container is allowed to be removed from the process cartridge.

FIG. 18 is a schematic illustration showing the process cartridge in the state in which the toner container is allowed to be removed from the process cartridge. The process cartridge CR shown in FIG. 18 is in the state in which the process cartridge CR is arranged at the mount portion 90 (see FIG. 1) of the apparatus body 1A like FIG. 17, although such a state is not illustrated in FIG. 18.

The state shown in FIG. 18 is also a state in which the sensor 134 installed on the developing unit 13 detects that the toner ratio of the toner in the developer becomes the predetermined ratio or lower, i.e., the sensor 134 detects that the toner container TC is empty, and the message for requesting the operator to replace the toner container TC is displayed on the display screen 84. When the sensor 134 detects that the toner container TC is empty, the restraining member 732 is rotated to the release position and is stopped by the rotation control of the driving stepping motor M. That is, the toner container TC is allowed to be removed from the container mount portion 73.

Even with the configuration described above with reference to FIGS. 17 and 18, the mechanism that inhibits the toner container TC from being removed from the process cartridge CR if the toner container TC is not empty is provided.

In the above-described exemplary embodiments, a monochromatic printer is used as an example of an image forming apparatus. However, the image forming apparatus is not limited thereto. For example, a color printer that forms a color image may be used.

In the above-described exemplary embodiments, a printer is used as an example of an image forming apparatus. However, the image forming apparatus is not limited to a printer. For example, a copier or a facsimile may be used.

In the above-described exemplary embodiments, the retention controller is a mechanism that completely releases the retention of the toner container with respect to the process cartridge. However, the retention controller is not limited thereto, and may be a mechanism that allows the retention of the toner container with respect to the process cartridge to be released by a manual operation of the operator.

In the above-described exemplary embodiments, the first information is the toner remaining amount information indicative of the remaining amount of the toner in the toner container. However, the first information is not limited thereto. The first information may be any information as long as the information is "information relating to the use amount of the toner in the toner container," such as the number of times of cumulative use of the photoconductor drum, the total amount of print area coverage, information indicative of the use amount of the toner in the toner container, information relating to the recovery amount of the toner in the toner recovery container, or a flag indicative of that the toner container is unused.

In the above-described exemplary embodiments, the second information is the drum cumulative use information indicative of the cumulative use amount of the photoconductor drum in the drum unit. However, the second information is not limited thereto. The second information may be any information as long as the second information is "information relating to the use amount of the drum unit," such as information indicative of the remaining use amount of the photoconductor drum in the drum unit.

In the above-described exemplary embodiments, the image holding portion is the drum unit DU in which the toner-image forming and holding section, the cleaner, the recovery toner housing box, the container mount portion, and the toner feeder 74 are installed. However, the image holding portion is not limited thereto. The image holding portion may include any component as long as the component does not include the toner container and includes at least the photoconductor drum from among the components installed in the process cartridge.

In the above-described exemplary embodiments, the empty detector is the sensor that detects the toner ratio of the toner in the developer in the developing unit. However, the empty detector is not limited thereto, and for example, the empty detector may be a sensor that is provided in the apparatus body of the image forming apparatus and detects a toner housed in a toner container having a light transmissive window, through the light transmissive window, a sensor that is provided in the toner container and directly detects the toner housed in the toner container, or an image density sensor that detects whether or not an image with a proper density is actually formed as the result of the toner feed.

In the above-described exemplary embodiments, the retaining mechanism is partly commonly used as the supply mechanism and hence is operated together with the supply mechanism. However, the retaining mechanism is not limited thereto, and for example, the retaining mechanism may be a mechanism that is operated independently from the supply mechanism, such as a mechanism that is operated by, for example, a solenoid or a dedicated motor.

In the above-described exemplary embodiments, the body memory serving as the housing storage stores the drum cumulative use information serving as the second information. However, the housing storage is not limited thereto, and may store both the first information and the second information.

In the above-described exemplary embodiments, the information update unit updates the drum cumulative use information in the cartridge memory every time when an image is formed and writes the backup of the drum cumulative use information in the body memory. However, the function of the information update unit is not limited thereto. The information update unit may frequently update one of the body memory and the cartridge memory and less frequently write the backup of the other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

an image holding body that is housed in the housing and holds a toner image;

an image forming unit that is housed in the housing and forms the toner image on the image holding body;

a cartridge that includes at least the image holding body and is removably mounted on the housing;

a toner container that is removably mounted on the cartridge, houses a toner therein, and supplies the toner to the image forming unit;

a retaining mechanism that retains the toner container with respect to the cartridge;

a storage that is provided at a certain position of at least one of the cartridge and the toner container and stores first information relating to a use amount of the toner in the toner container and second information relating to a use amount of an image holding portion, which is a component not including the toner container and including at least the image holding body from among components installed in the cartridge;

an information update unit that updates the first information in accordance with use of the toner in the toner container, and updates the second information in accordance with use of the image holding portion;

an empty detector that is housed in the housing and detects whether or not the toner container is empty;

a retention controller that at least allows the toner container retained by the retaining mechanism to be released if the empty detector detects that the toner container is empty, and causes the retaining mechanism to retain the toner container if the empty detector detects that the toner container is not empty; and an information rewrite unit that rewrites information stored in the storage if the empty detector detects that the toner container is empty and the toner container is at least allowed to be released, and then if the empty detector detects that the toner container is not empty, wherein the cartridge includes a supply mechanism that handles at least part of toner supply from the toner container to the image forming unit, wherein the retaining mechanism is at least partly commonly used as the supply mechanism, operated together with the supply mechanism, and provides a retained state in which the retention of the toner container is not released and a release state in which the retention is at least allowed to be released, by the operation, and wherein the retention controller also serves as a supply controller that controls the toner supply from the toner container to the image forming unit by controlling the operation of the supply mechanism.

2. The image forming apparatus according to claim 1, wherein the storage is installed on the image holding portion, and wherein the information rewrite unit rewrites the first information stored in the storage into information corresponding to start of the use of the toner if the empty detector detects that the toner container is empty and the toner container is at least allowed to be released, and then if the toner detector detects that the toner container is not empty.

3. The image forming apparatus according to claim 1, wherein the storage is a container storage installed on the toner container, wherein the image forming apparatus further comprises a housing storage that stores at least the second information and remains in the housing when the cartridge is removed from the housing, and wherein the information rewrite unit rewrites second information stored in the container storage into second information stored in the housing storage if the empty detector detects that the toner container is empty and the toner container is at least allowed to be released, and then if the toner detector detects that the toner container is not empty.

* * * * *